US009640113B2

(12) United States Patent
Wang

(10) Patent No.: US 9,640,113 B2
(45) Date of Patent: May 2, 2017

(54) COMPENSATION CIRCUIT DESIGN OF ACTIVE ORGANIC LIGHT EMITTING DIODE DISPLAY SYSTEM

(71) Applicant: BOE Technology Group Co., Ltd., Beijing (CN)

(72) Inventor: Ying Wang, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 116 days.

(21) Appl. No.: 14/554,908

(22) Filed: Nov. 26, 2014

(65) Prior Publication Data

US 2016/0117986 A1 Apr. 28, 2016

(30) Foreign Application Priority Data

Oct. 24, 2014 (CN) ..... 2014 1 0575717

(51) Int. Cl.

*G09G 3/30* (2006.01)
*G09G 3/3258* (2016.01)
*G09G 3/3283* (2016.01)

(52) U.S. Cl.

CPC ..... *G09G 3/3258* (2013.01); *G09G 3/3283* (2013.01); *G09G 2300/0819* (2013.01); *G09G 2300/0842* (2013.01); *G09G 2300/0861* (2013.01); *G09G 2320/0223* (2013.01); *G09G 2320/0295* (2013.01); *G09G 2320/0693* (2013.01)

(58) Field of Classification Search

CPC ..... G09G 3/3258; G09G 2320/04; G09G 2300/0809

See application file for complete search history.

(56) References Cited

U.S. PATENT DOCUMENTS

2010/0253608 A1* 10/2010 Kim ..... G09G 3/3233 345/76
2011/0205221 A1* 8/2011 Lin ..... G09G 3/2092 345/213
2011/0216056 A1* 9/2011 Yoo ..... G09G 3/32 345/212
2011/0227505 A1* 9/2011 Park ..... H05B 33/0896 315/297

* cited by examiner

*Primary Examiner* — Kwang-Su Yang
(74) *Attorney, Agent, or Firm* — Banner & Witcoff, Ltd.

(57) ABSTRACT

A compensation circuit of IR drop of a display system, the display system having m pixel circuits, the compensation circuit comprising: m current comparators composed of TFT devices, wherein each current comparator is configured to compare the input current signal with a reference current signal and output a voltage signal according to the comparison result; m encoders composed of TFT devices, wherein each encoder is configured to encode the voltage signal into a digital voltage signal to output; a controller which is configured to calculate a difference value between the digital voltage signal and an ideal digital voltage signal and generate a digital difference signal; m compensation voltage generators each of which is configured to convert the digital difference signal into a compensation voltage signal, and write the compensation voltage signal into a corresponding pixel circuit according to control of a timing control signal; and a driver IC.

9 Claims, 8 Drawing Sheets

COMPENSATION CIRCUIT DESIGN OF ACTIVE ORGANIC LIGHT EMITTING DIODE DISPLAY SYSTEM

This application claims priority to Chinese Patent Application No. 201410575717.9, filed on Oct. 24, 2014. The present application claims priority to and the benefit of the above-identified application and is incorporated herein in its entirety.

TECHNICAL FIELD

The present application relates to an active organic light emitting diode display backplate, in particular to an implementation of a compensation system of IR drop for the active organic light emitting diode display backplate.

BACKGROUND

In an active organic light emitting diode display system, the glow brightness of an organic light emitting diode (OLED) is proportional to a driving current, and has an exponential relationship with a driving voltage signal. Therefore, under a low grayscale display state, the variation of its glow brightness is very sensitive to the variation of the driving voltage signal. In an AMOLED (Active Matrix/Organic Light Emitting Diode) display panel, signal transmission loss on a power signal line will cause a variation of the driving voltage signal of the OLED device, thus effecting display uniformity. Therefore, a compensation technique is often introduced into the design of the backplate circuit to compensate it, wherein an external compensation is a mode that is often adopted. The external compensation is implemented by adopting a pixel circuit having a compensation function cooperating with a customized driving chip. The adopted pixel circuit structure is for example 3T1C or 4T2C, etc. The initiation of the compensation mechanism often needs a peripheral module circuit to provide a special module to complete.

As for the compensation of IR drop on the power line, it needs to conduct sampling first. A sampled signal may be a current signal or a voltage signal. The sampled signal needs to be judged necessarily to confirm whether a compensation operation needs to be conducted. For example, if $\Delta V$ caused by IR drop is greater than a gray scale driving voltage difference, then compensation is needed. After judging the sampled signal, if compensation is needed, then a compensation voltage generator is started to generate a compensation voltage signal, which is fed back to the pixel circuit having a compensation function design on a timing signal control line of the driving chip to implement the compensation of IR drop on the power line.

SUMMARY

Additional aspects and advantages of the present invention will be in part set forth in the description which follows, and in part will be apparent from the description, or may be learned by practice of the invention.

The present invention provides a design method of an active organic LED display system adopting a compensation technique, by which, compensation for IR drop of a power line can be implemented, thus enhancing display uniformity and display quality.

In the AMOLED display technique, since the glow brightness of the OLED is very sensitive to the variation of the driving voltage signal, the signal transmission loss in a backplate circuit and a module circuit will cause display nonuniformity. In order to improve display quality, an external compensation technique is often adopted to reduce the effect of IR drop. The present invention provides a compensation system design for power supply ELVDD, the core of which is to sample an ELVDD signal within a pixel area, wherein if it is judged that a voltage drop on the ELVDD signal has been sufficient to cause nonuniformity of a displayed picture, then a compensation mechanism is initiated, i.e., a compensation voltage generator generates a compensation voltage signal which is fed back to a pixel circuit to make necessary compensation to ELVDD, reducing nonuniformity of the displayed picture caused by ELVDD in the pixel area, particularly an effect for a low gray scale display picture.

The present application provides a compensation circuit of IR drop of a display system, the system having m pixel circuits, the compensation circuit comprising: m current comparators composed of TFT (Thin Film Transistor) devices, wherein each current comparator is connected with a pixel circuit, each current comparator is configured to receive a sampled input current signal of an ELVDD signal from the connected pixel circuit, compare the input current signal with a reference current signal and output a voltage signal according to the comparison result; m encoders composed of TFT devices, wherein each encoder is connected with a current comparator, each encoder is configured to receive the voltage signal from the connected current comparator, and encode the voltage signal into a digital voltage signal to output; a controller which is configured to calculate a difference value between the digital voltage signal from each encoder and an ideal digital voltage signal and generate a digital difference signal; m compensation voltage generators, wherein each compensation voltage generator corresponds to a pixel circuit, each compensation voltage generator is configured to convert the digital difference signal into a compensation voltage signal, and write the compensation voltage signal into a corresponding pixel circuit according to control of a timing control signal of a driver chip IC; and, a driver IC which is configured to generate the timing control signal according to a column line input signal of each pixel circuit, wherein m is a natural number.

By adopting a TFT device to implement the current comparator circuit and the encoder circuit, the part of the circuits can be integrated on a glass substrate, which greatly enhances system integration of the whole display system and decreases complexity of a peripheral circuit. In the meantime, due to reducing of leads, noise interference in the course of signal transmission is decreased, improving the performance of the circuit. And since the manufacturing processes are identical, there is no extra preparation cost.

BRIEF DESCRIPTION OF THE DRAWINGS

The above mentioned objects, features and advantages of the present invention will become more apparent from the following detailed description of preferred embodiments of the present invention taken in conjunction with the accompanying drawings, in which identical reference numbers refer to units having identical structures, and in which.

DETAILED DESCRIPTION

Figure 1:
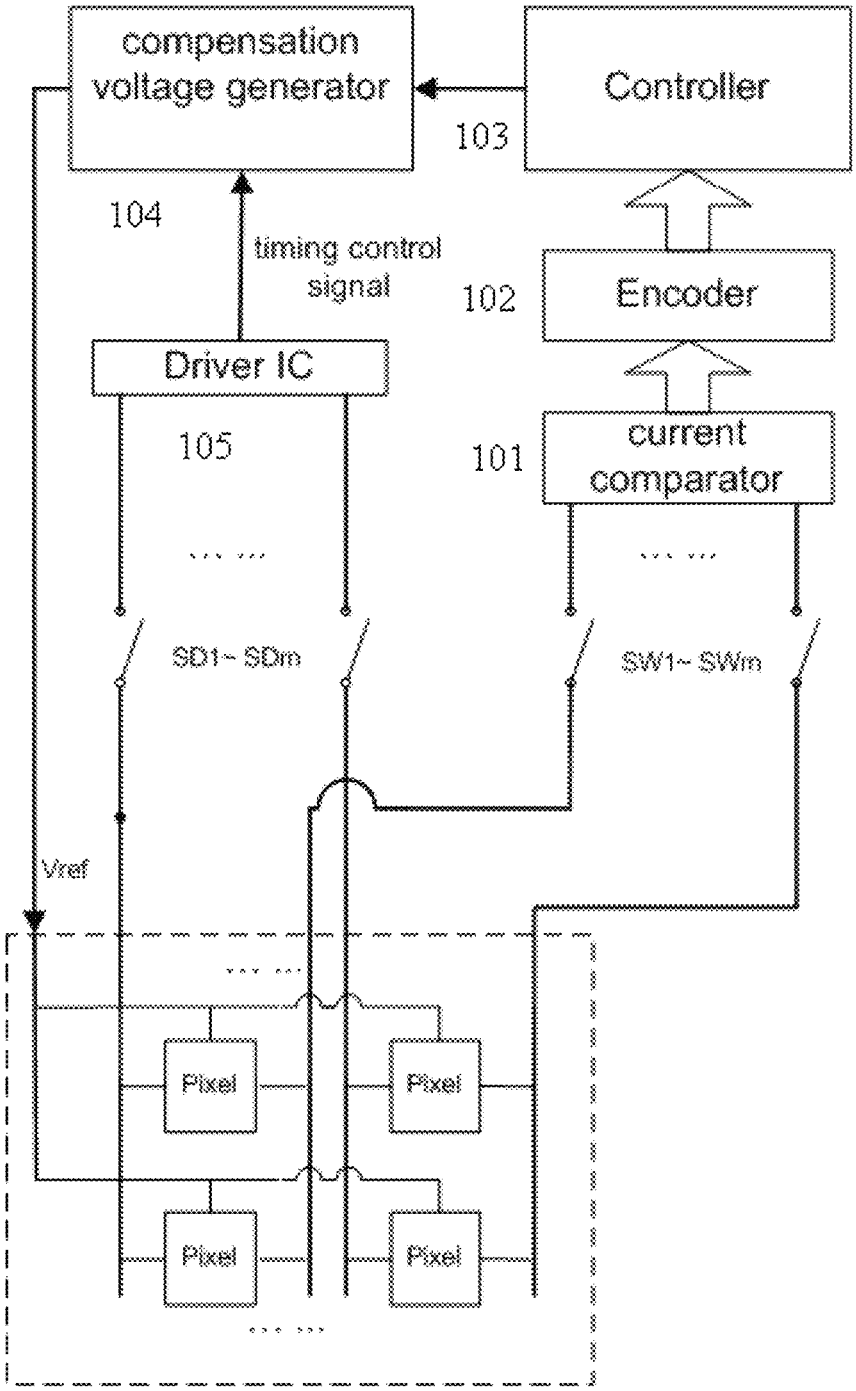
FIG. 1 shows a block diagram of the structure of a compensation circuit of IR drop of power supply ELVDD according to an embodiment of the present invention.

The present disclosure will be fully described with reference to the drawings showing the embodiments of the present invention. However, the present disclosure can be implemented in a lot of different forms, and should not be considered as limiting to the embodiments described herein. Instead, these embodiments are provided so that the present disclosure is thorough and complete, and expresses fully the scope of the present invention to those skilled in the art. In the drawings, components are enlarged for clarity.

It will be understood that when an element is referred to as being "connected to" or "coupled to" another element, it can be directly connected or coupled to the other element or intervening elements may be present. In contrast, when an element is referred to as being "directly connected to" or "directly coupled to" another element, there are no intervening elements present. Like reference symbols refer to like elements. As used herein, the term "and/or" includes any and all combinations of one or more of the associated listed items.

It will be understood that, although the terms first, second, third etc. may be used herein to describe various elements, components, and/or sections, these elements, components, and/or sections should not be limited by these terms. These terms are only used to distinguish one element, component, or section from each other. Thus, a first element, component, or section discussed below could be termed a second element, component, or section without departing from the teachings of the present invention.

The terminology used herein is for the purpose of describing particular example embodiments only and is not intended to be limiting of the present invention. As used herein, the singular forms "a," "an" and "the" are intended to include the plural forms as well, unless the context clearly indicates otherwise. It will be understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 shows a block diagram of the structure of a compensation circuit of IR drop of power supply ELVDD according to an embodiment of the present invention.

Figure 2:
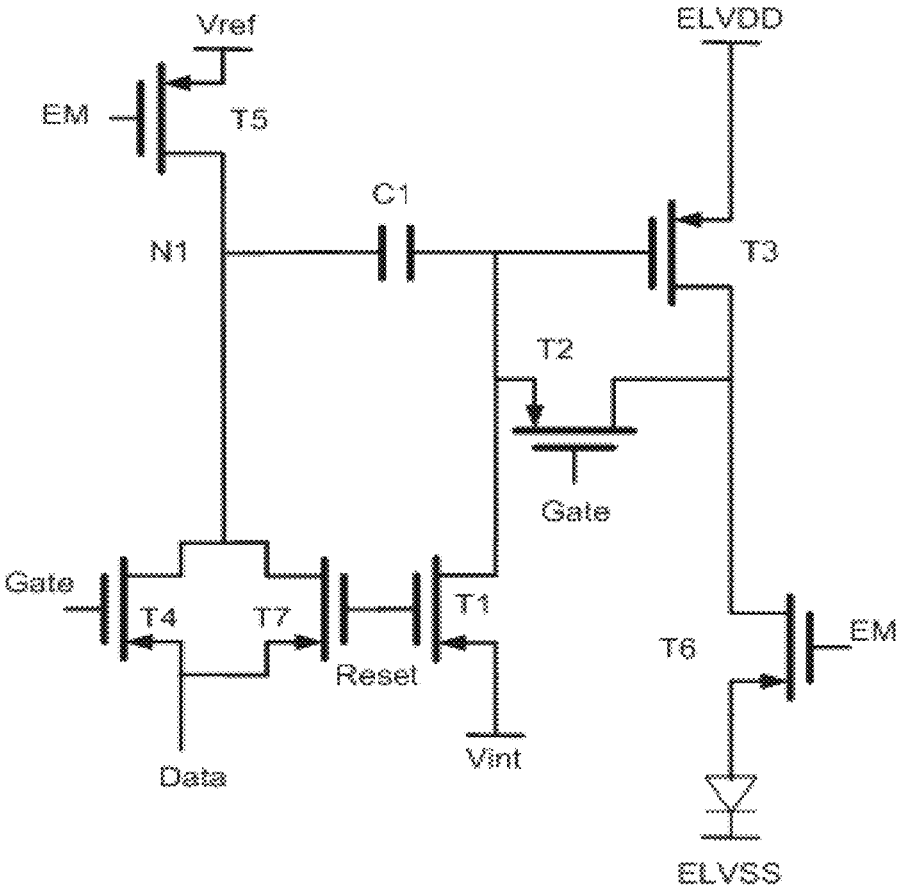
FIG. 2 shows a schematic diagram of a pixel circuit according to an embodiment of the present invention.

FIG. 2 shows a schematic diagram of a pixel circuit according to an embodiment of the present invention.

The block diagram of the structure of a compensation circuit of IR drop of power supply ELVDD of an AMOLED display system in the present application is as shown in FIG. 1. The system adopts the pixel circuit design shown in FIG. 2.

As shown in FIG. 1, the compensation circuit of the AMOLED display system comprises m current comparators 101 composed of TFT devices, m encoders 102 composed of TFT devices, a controller 103, m compensation voltage generators 104 and a driver IC 105, where m is a natural number.

As shown in FIG. 1, a display panel contains m pixel circuits, and with respect to each pixel circuit, its ELVDD signal needs to be sampled, and compensated. Therefore, m current comparators 101, m encoders 102, and m compensation voltage generators 104 are needed. Since the structure of each element is identical, a description will be made below with respect to one current comparator, one encoder and one compensation voltage generator for brevity.

In FIG. 1, Vref voltage is a compensation voltage signal compensating IR drop of supply voltage ELVDD. The sampling operation for ELVDD can be conducted between two frames of pictures, i.e., an ELVDD signal of each pixel area in an active display area is sampled, and the sampled signal is a current signal which will be supplied into the current comparator 101.

Each current comparator 101 receives a sampled input current signal of the ELVDD signal from a respective pixel circuit, compares the input current signal with a reference current signal, and outputs a voltage signal according to the comparison result. That is, the input current signal will also be converted into a voltage signal after passing the current comparator 101.

The encoder 102 receives the voltage signal, and encodes the voltage signal into a digital voltage signal to output.

The controller 103 compares the digital voltage signal and an ideal digital voltage signal, and generates a digital difference signal. The compensation voltage generator 104 converts the digital difference signal into a compensation voltage signal, and writes the compensation voltage signal into a display pixel circuit according to the control of the timing control signal of the a driver IC 105, to achieve the object of compensation for ELVDD.

The driver IC 105 is configured to generate a timing control signal according to a column line input signal of each pixel circuit.

As shown in FIG. 2, the pixel circuit comprises a data line Data, a gate line Gate, a first power line ELVDD, a second power line ELVSS, a light emitting device, a driving transistor T3, a storage capacitor C1, a compensation signal line Vref, a reset unit, a data writing unit, a compensation unit and a light emission control unit. The reset unit comprises a reset control line Reset, a reset signal line Vint, a first transistor T1 and a seventh transistor T7. The data writing unit includes a fourth transistor T4. The compensation unit comprises a second transistor T2. The light emission control unit comprises a light emission control line EM, a fifth transistor T5 and a sixth transistor T6.

Figure 3:
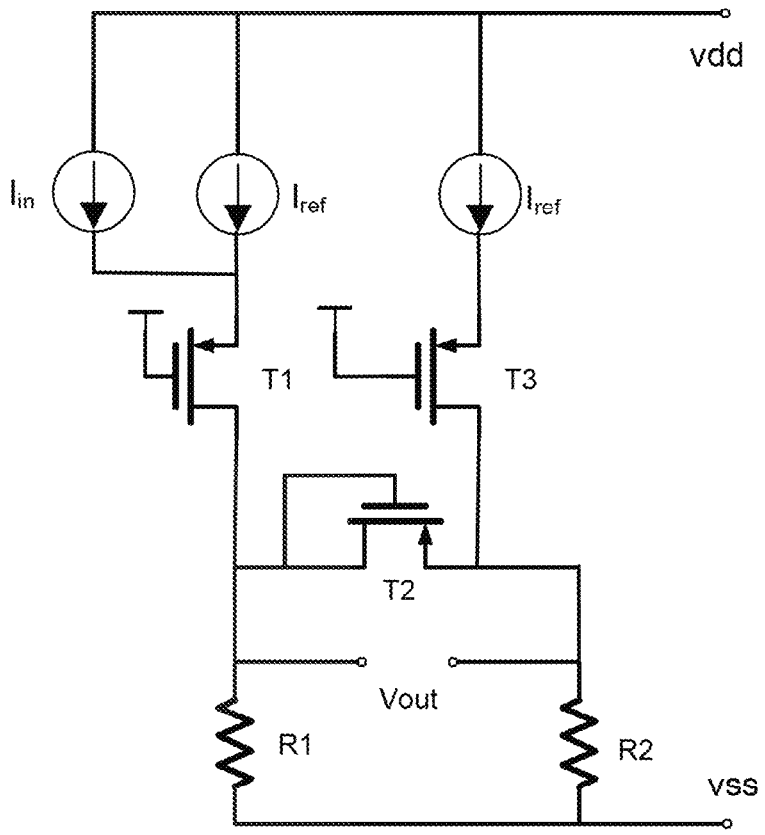
FIG. 3 shows a circuit diagram of a current comparator of FIG. 1 according to an embodiment of the present invention.

FIG. 3 shows a circuit diagram of a current comparator of FIG. 1 according to an embodiment of the present invention.

Those skilled in the art should understand, the current comparator according to the embodiments of the present invention is not limited to the circuit diagram described in FIG. 3, and other circuit diagrams capable of implementing identical functions, obtained by modifying based on FIG. 3, are also within the scope of the present invention.

As shown in FIG. 3, the current comparator comprises transistors T1, T2 and T3 as well as resistors R1 and R2. Transistor T1 and transistor T3 constitute a current mirror. The gates of transistor T1 and transistor T3 are grounded, the source of transistor T1 is connected with one end of an input current source circuit and one end of a reference current source circuit, the other end of the input current source circuit and the other end of the reference current source circuit is connected with a voltage vdd, the source of transistor T3 is connected with the reference current source circuit, the drain of transistor T1 is connected with the drain of transistor T2, and the drain of transistor T3 is connected with the source of transistor T2. The gate and drain of transistor T2 are connected with each other to constitute a forward biased diode circuit, and the intersection point of the gate and drain of transistor T2 is connected to the first end of a resistor R1, the source of transistor T2 is connected to the first end of resistor R2. The second ends of resistor R1 and resistor R2 are connected to VSS. The first end of resistor R1 and the first end of resistor R2 are voltage signal output ends Vout.

The resistance values of the load resistors R1=R2=R. Iref is a current source circuit, where Iref is a standard reference current value, and Iin is an input current value. If Iin=Iref, then both T1 and T3 output a Iref current, at which time T2 is off, and the currents passing on R1 and R2 are both Iref, and the output voltages Vout is 0V; if Iin≠Iref, for example, Iin=1.5Iref, then at this time T2 will be on, the current passing R2 becomes 1.5Iref, while the current passing R1 is still Iref, at which time Vout is 0.5IrefR.

FIG. 3 is only a specific circuit implementation of the current comparator. For n pixels shown in FIG. 1, n current comparators shown in FIG. 3 are needed.

Figure 4:
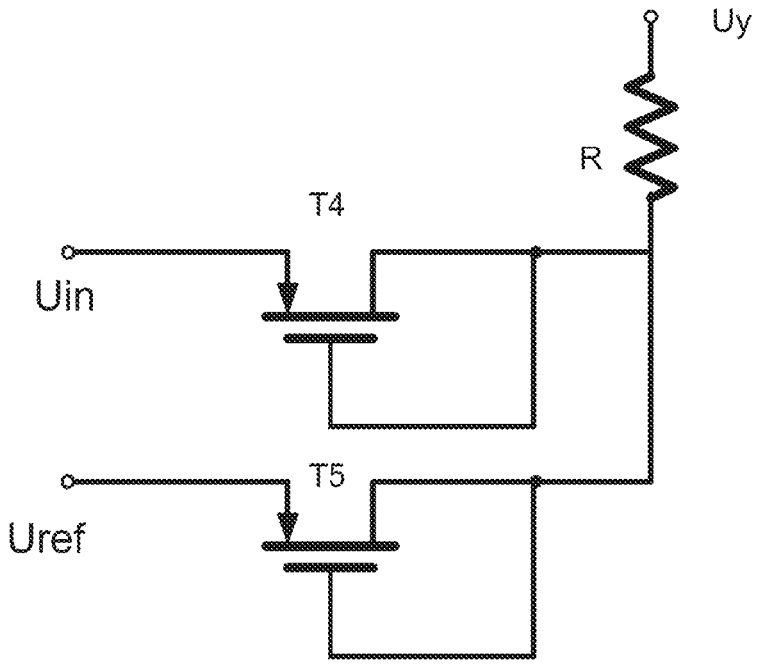
FIG. 4 shows a circuit diagram of an encoder unit according to an embodiment of the present invention.

FIG. 4 shows a circuit diagram of an encoder unit according to an embodiment of the present invention. Those skilled in the art should understand, the encoder unit according to the embodiments of the present invention is not limited to the circuit diagram described in FIG. 4, other circuit diagrams capable of implementing identical functions are also within the scope of the present invention.

FIG. 4 is a circuit diagram of an encoding unit of voltage. When the compensation circuit according to the embodiments of the present invention has a not high requirement for precision, for example, only one-bit digital voltage output is needed, the encoder according to the embodiments of the present invention contains an encoder unit shown in FIG. 4.

As shown in FIG. 4, the encoder unit is an and gate circuit composed of two forward biased transistors T4 and T5, where Uin is an input voltage end, that is, the output voltage Vout from FIG. 3 is received, Uref is a reference voltage terminal, the drains and gates of transistors T4 and T5 are connected with each other to constitute a diode connection, i.e., unidirectional current flow is ensured, the source of transistor T4 constitutes Uin input voltage end, and the source of transistor T5 constitutes Uref reference voltage end. The intersection points of the drains and gates of transistors T4 and T5 constitute a voltage output end through a resistor R to output a digital voltage signal Uy.

The operation state of the circuit is as shown in Table 1, which is converted into a logical circuit truth table as shown in FIG. 2. Then, by using the encoder unit, the voltage signal Uin output by the current comparator can be converted into a digital voltage signal.

TABLE 1

Operation state table of the encoder unit

| Input | | Output |
|---|---|---|
| Uin (V) | Uref (V) | Uy (V) |
| 0 | 0 | 0 |
| 0 | +5 | 0 |
| +5 | 0 | 0 |
| +5 | +5 | +5 |

TABLE 2

Truth table of the encoder unit

| Input | | Output |
|---|---|---|
| Uin | Uref | Uy |
| 0 | 0 | 0 |
| 0 | 1 | 0 |
| 1 | 0 | 0 |
| 1 | 1 | 1 |

By using the encoder 102, the voltage signal output after the sampling current with respect to each pixel is processed by the current comparator 101 is finally converted into a digital voltage signal.

For each pixel, the number of the encoder units contained in the encoder 102 depends on the necessary precision of the circuit. For example, when the requirement for the precision of the whole compensation circuit is relatively high, such as, it needs to output an eight-bit digital voltage signal, that is, a 256-gray scale image need to be processed, 8 encoder units are needed. An encoder composed on the encoder units is as shown in FIG. 5.

Figure 5:
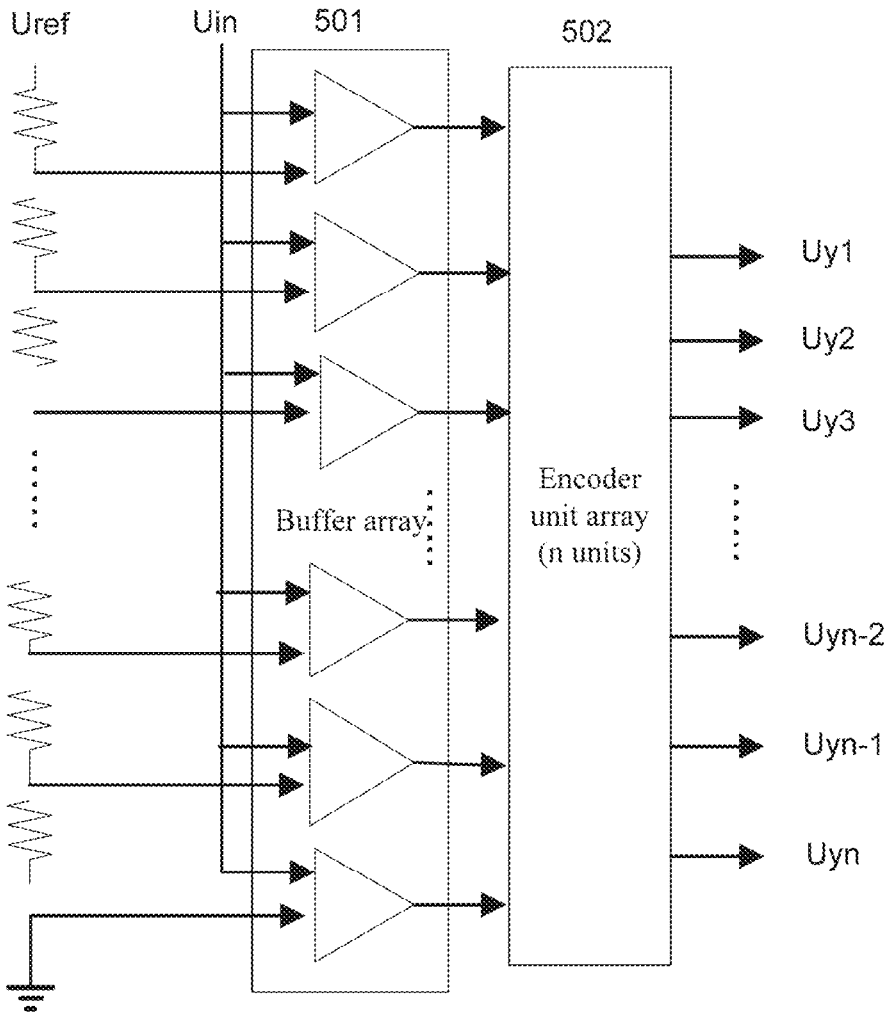
FIG. 5 shows a whole circuit diagram of an encoder according to an embodiment of the present invention.

FIG. 5 shows a whole circuit diagram of an encoder according to an embodiment of the present invention.

As shown in FIG. 5, the encoder comprises a buffer array 501 and a encoder unit array 502. The buffer array 501 contains n buffers and is configured to buffer and amplify the voltage signals from the current comparator and n reference voltage signals, and outputs the n voltage signals and the n reference voltage signals to the encoder unit array 502. The encoder unit array 502 contains n encoder units. The input voltage end of each encoder unit receives one of the n voltage signals, and the reference voltage end of each encoder unit receives one of n reference voltage signals. The voltage output end of each encoder unit in the encoder unit array 502 outputs an one-bit digital voltage signal Uyi, to generate an n-bit digital voltage signal. Therein, n is a natural number and is determined according to practical needs for the precision of the compensation circuit.

Figure 6:
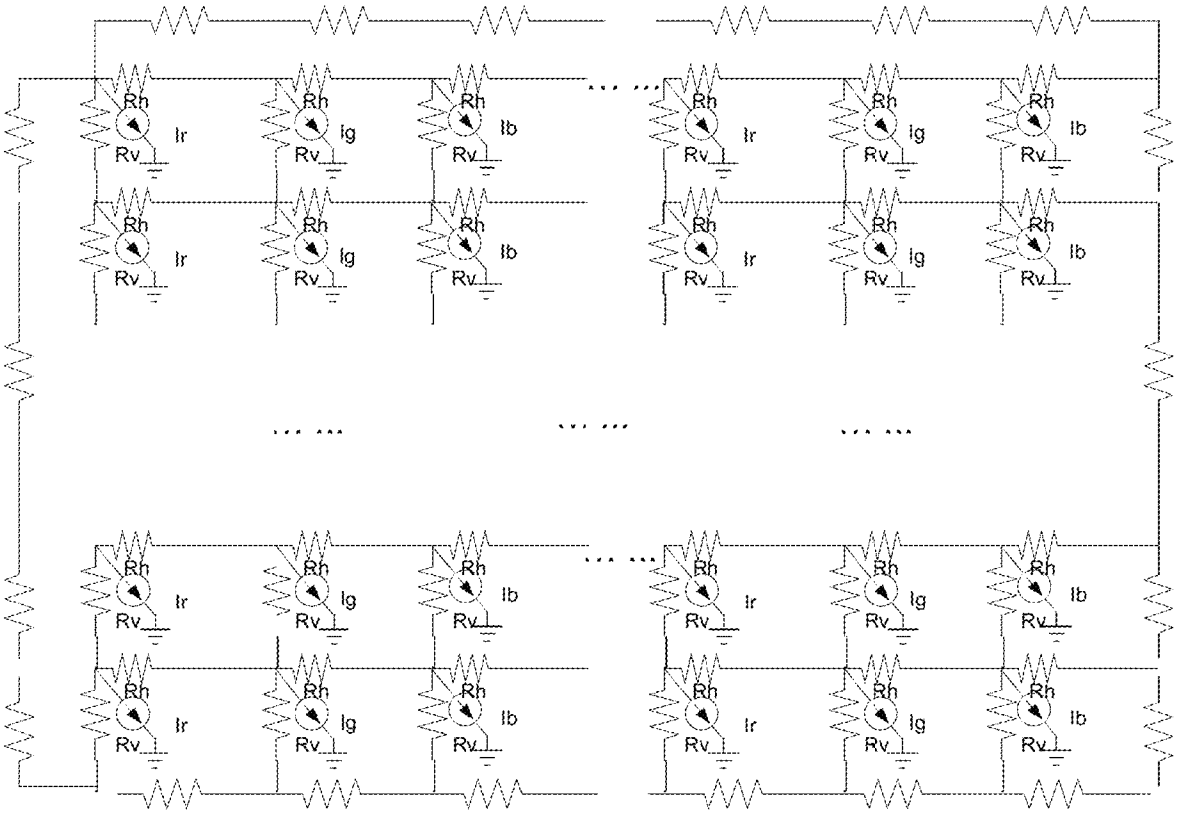
FIG. 6 shows a simplified model of a resistance network of a pixel area circuit according to an embodiment of the present invention.

FIG. 6 shows a simplified model of a resistance network of a pixel area circuit according to an embodiment of the present invention. FIG. 6 is a model simplified with respect to the pixel matrix in OLED display. But those skilled in the art should understand that the simplified model of another pixel matrix can also be adopted.

Figure 7:
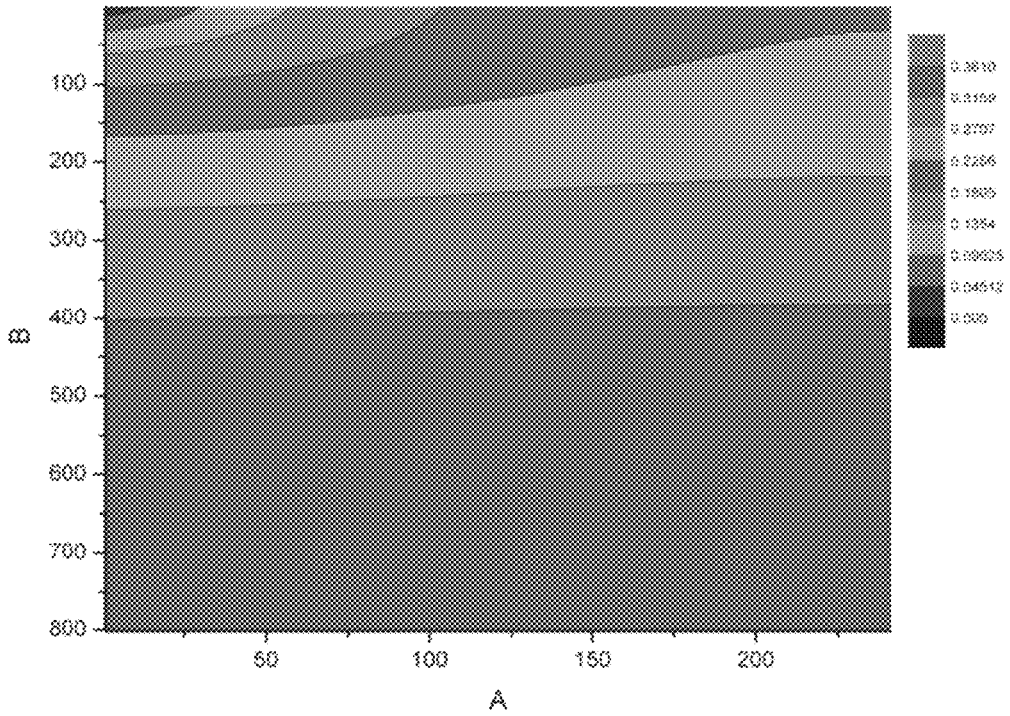
FIG. 7 shows a IR drop distribution diagram of a half panel of a WVGA AMOLED backplate according to an embodiment of the present invention.

FIG. 7 is a contoured distribution diagram of a supply voltage when a pixel circuit for displaying an all white picture operates normally.

In case of an all white picture, through theoretically analyzing, the current of the supply voltage is the maximum, i.e., the DC voltage drop is the maximum. Then taking this as a minimum standard for judging whether a compensation is needed, if the ELVDD voltage of a certain pixel point obtained by sampling is lower than the ELVDD of the all white picture corresponding to this point, then at this time, a compensation should be performed on the point.

However, those skilled in the art should understand that, although the all white picture is taken as an example in the description in the FIG. 7 of the present application, in a practical application, a calculation can be done by using a real picture to obtain a voltage distribution diagram of a pixel array, which is thus used to make a more accurate compensation.

The processing for the digital voltage signal output by the encoder 102 is completed by the controller 103 such as an FPGA or a special IC. The controller 103 performs a corresponding calculation of the compensation voltage signal mainly by way of a lookup table. The specific method is to use a way of an equivalent circuit, calculate the voltages in a pixel area, respectively, calculate an ideal voltage value of each pixel point in a no compensation case and stores it into a lookup table. The equivalent circuit used by it for calculating a voltage distribution is as shown in FIG. 6, and an ideal voltage distribution diagram can be calculated according to a pixel image. The contoured voltage distribution diagram is as shown in FIG. 7.

The abscissa of FIG. 7 is the number of columns of the pixel matrix, and the ordinate is the number of rows in the pixel matrix. The figure is a contoured voltage distribution diagram of a half pixel matrix, and the voltage values of the pixel points read out from the figure are the ideal voltage values in the look-up table in the controller 103.

The controller 103 can judge whether the voltage of the sampled pixel point needs a compensation by comparing the voltage signal output by the encoder 102 with the ideal voltage values in the look-up table. That is, if the two values are inconsistent, a compensation is need. Otherwise no compensation is needed.

If a compensation is needed, then the compensation voltage signal is obtained by the controller 103 by calculating the difference values between the two signals.

Figure 8:
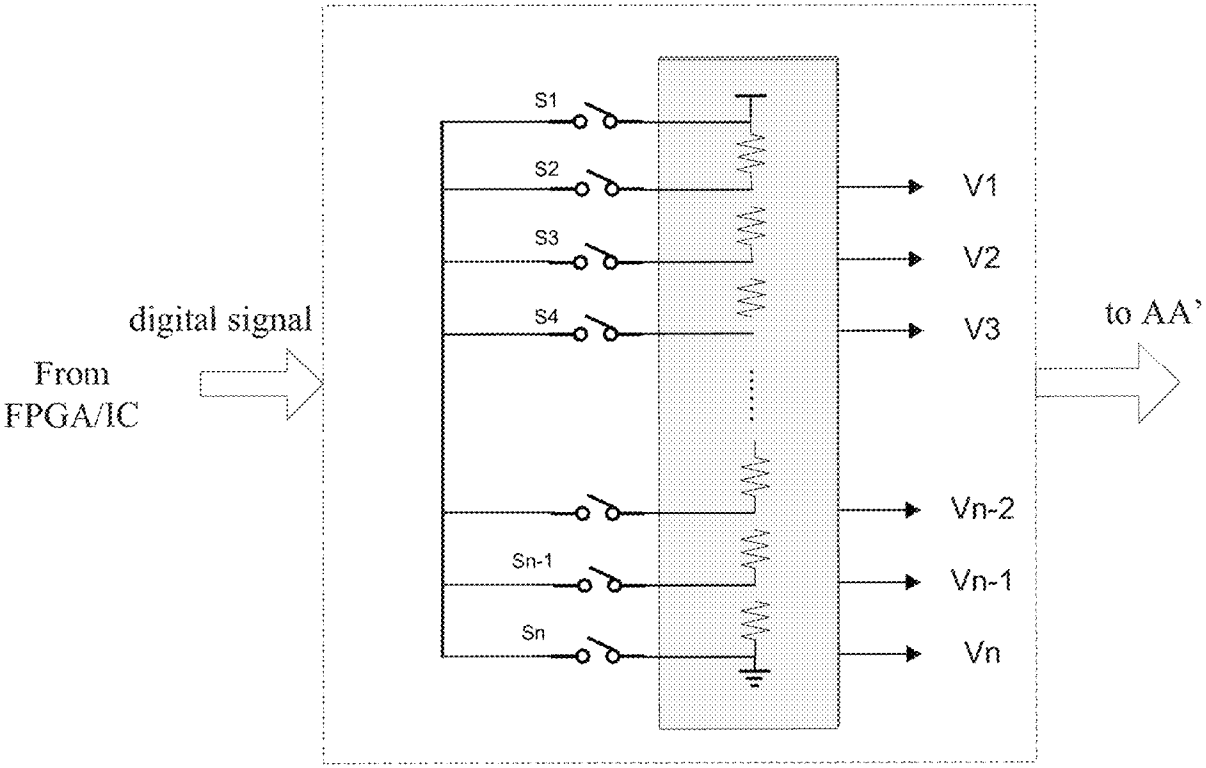
FIG. 8 shows a DAC conversion circuit according to an embodiment of the present invention.

FIG. 8 shows a DAC conversion circuit according to an embodiment of the present invention.

The compensation voltage signal obtained by the controller 103 through calculation is input into the compensation voltage generating circuit 105. As shown in FIG. 8, the core of the compensation voltage generating circuit 105 is a DAC conversion circuit, which generates a compensation voltage value according to the compensation voltage signal, that is, converts the compensation voltage signal into an analog compensation voltage value, and feeds back and inputs it into the pixel circuit, implementing compensation for ELVDD.

FIG. 8 is a common voltage type DAC circuit structure, the output of which is only a voltage.

For example, when the input S1S2 . . . Sn=10 . . . 0, then the output voltage is Vout=V1=IR. When the input S1S2 . . . Sn=11 . . . 0, then the output is Vout=V2=IR+2IR=3IR.

. . .

and so on.

Then Vout of the circuit is Vref in FIG. 1, and it is provided to the pixel circuit for corresponding compensation.

While the present invention is described in conjunction with the embodiments which are considered as the most practical and best currently, those skilled in the art should understand that the present invention is not limited to the disclosed embodiments. Instead, the present invention aims at cover various modifications and equivalent structures within the spirit and scope of the appended claims.

The invention claimed is:

1. A compensation circuit of IR drop of a display system, the display system having m pixel circuits, the compensation circuit comprising:

m current comparators composed of TFT (Thin Film Transistor) devices, wherein each current comparator is connected with a pixel circuit, each current comparator is configured to receive a sampled input current signal of a power supply (ELVDD) signal from the connected pixel circuit, compare the input current signal with a reference current signal and output a voltage signal according to the comparison result;

m encoders composed of TFT devices, wherein each encoder is connected with a current comparator, each encoder is configured to receive the voltage signal from the connected current comparator, and encode the voltage signal into a digital voltage signal to output;

a controller which is configured to calculate a difference value between the digital voltage signal from each encoder and an ideal digital voltage signal and generate a digital difference signal;

m compensation voltage generators, wherein each compensation voltage generator corresponds to a pixel circuit, each compensation voltage generator is configured to convert the digital difference signal into a compensation voltage signal, and write the compensation voltage signal into a corresponding pixel circuit according to control of a timing control signal of a driver IC (Integrated Circuit); and, the driver IC which is configured to generate the timing control signal according to a column line input signal of each pixel circuit and output the timing control signal to the m compensation voltage generators, wherein m is a natural number.

2. The compensation circuit according to claim 1, wherein each current comparator comprises a first to a third transistors and a first and a second resistors; gates of both the first and third transistors are grounded, a source of the first transistor is connected to a reference current signal and an input current signal from the pixel circuit, a source of the third transistor is connected to the reference current signal, a drain of the first transistor is connected to a drain of the second transistor, a drain of the third transistor is connected to a source of the second transistor, a gate of the second transistor is connected with a drain of the second transistor, an intersection point of the gate and drain of the second transistor is connected to a first end of a first resistor, the source of the second transistor is connected to a first end of a second resistor, second ends of the first and second resistors are connected with a voltage (VSS), and, the first end of the first resistor and the first end of the second resistor constitute a signal output end to output a voltage signal.

3. The compensation circuit according to claim 2, wherein resistance values of the first and the second resistors are equal to a resistance value (R); when the input current signal is equal to the reference current signal, both the first and second transistors output a reference current, the second transistor is cut off, and the output voltage signal is 0V; and, when the input current signal is not equal to the reference current signal, the second transistor is on, at which time the output voltage signal is a product of the difference value between the input current signal and the reference current signal and the resistance value R.

4. The compensation circuit according to claim 3, wherein each encoder circuit comprises an encoder unit, which comprises a fourth transistor and a fifth transistor, a drain and a gate of the fourth transistor is connected with each other, a source of the fourth transistor constitutes an input voltage end to receive an output voltage signal from the current comparator, a drain and a gate of the fifth transistor is connected with each other, a source of the fifth transistor constitutes an reference voltage end to receive an reference voltage signal, and an intersection point of the drain and gate of each of the fourth and the fifth transistors constitutes digital voltage output ends through a third resistor to output a digital voltage signal.

5. The compensation circuit according to claim 4, wherein if the compensation circuit needs to output an n-bit digital voltage signal, then each encoder comprises:

a buffer array containing n buffers, configured to buffer and amplify the voltage signal from the current comparator and n reference voltage signals, and output the n voltage signals and the n reference voltage signals to an encoder unit array; and the encoder unit array containing n encoder units, wherein an input voltage end of each encoder unit receives one of the n voltage signals, a reference voltage end of each encoder unit receives one of the n reference voltage signals, and a voltage output end of each encoder unit outputs a one-bit digital voltage signal to generate a n-bit digital voltage signal, where n is a natural number.

6. The compensation circuit according to claim 5, wherein the controller calculates an ideal voltage value of each pixel circuit in a no compensation case and stores it into a lookup table by using an equivalent circuit of the pixel circuit, and calculates a compensation voltage signal by using the lookup table.

7. The compensation circuit according claim 6, wherein the controller compares the digital voltage signal output by each encoder and a corresponding ideal voltage signal in the lookup table, and when the two signals are not equal, then it is judged that a compensation needs to be conducted, and otherwise, it is judged that no compensation is needed.

8. The compensation circuit according to claim 7, wherein the controller obtains a compensation voltage signal by calculating a difference value between the voltage signal output by each encoder and the ideal voltage signal in the lookup table.

9. The compensation circuit according to claim 8, wherein each compensation voltage generating circuit comprises a digital to analog conversion circuit (DAC) configured to convert the compensation voltage signal into an analog compensation voltage value, and feed back and input the analog compensation voltage value into a corresponding pixel circuit according to control of a timing control signal.

* * * * *